United States Patent [19]

Shively et al.

[11] 4,286,240

[45] Aug. 25, 1981

[54] CIRCULAR ELECTRIC MODE MICROWAVE WINDOW

[75] Inventors: James F. Shively, Los Altos Hills; Steven J. Evans, Mountain View; Howard R. Jory, Menlo Park; Yosuke M. Mizuhara, Palo Alto, all of Calif.

[73] Assignee: Varian Associates, Inc., Palo Alto, Calif.

[21] Appl. No.: 99,768

[22] Filed: Dec. 3, 1979

[51] Int. Cl.[3] ..... H01P 1/08; H01P 1/16

[52] U.S. Cl. ..... 333/252; 333/251; 333/254

[58] Field of Search ..... 333/252, 251, 248, 22 F, 333/81 B, 13, 27, 99 PL, 254; 313/12

[56] References Cited

U.S. PATENT DOCUMENTS

| | | | |
|---|---|---|---|
| 2,400,777 | 5/1946 | Okress | 333/248 X |
| 3,100,881 | 8/1963 | Edson | 333/252 X |
| 3,324,427 | 6/1967 | Weiss | 333/252 |

FOREIGN PATENT DOCUMENTS

| | | | |
|---|---|---|---|
| 669250 | 4/1952 | United Kingdom | 333/252 |

*Primary Examiner*—Marvin L. Nussbaum

*Attorney, Agent, or Firm*—Stanley Z. Cole; Richard B. Nelson; Peter J. Sgarbossa

[57] ABSTRACT

For conducting very high microwave power at very high frequencies, circular waveguide transmitting a circular-electric-field mode is used. The vacuum-tight window of an electron tube is often the element with lowest power-handling capability. The inventive window has two dielectric plates with a space between them. There is a gap in the waveguide inner wall through which a dielectric fluid is circulated between the plates to cool them. The gap leads to a region containing wave-absorbing material such as water to absorb modes other than the circular-electric-field mode.

4 Claims, 2 Drawing Figures

CIRCULAR ELECTRIC MODE MICROWAVE WINDOW

DESCRIPTION

1. Field of the Invention

The invention pertains to high power microwave transmission. A waveguide window is often needed to get the power into or out of a vacuum device such as an electron tube or plasma chamber or a pressurized section of waveguide.

2. Prior Art

Circular waveguides carrying a circular-electric-field mode have been used where the utmost in power-handling ability and low transmission loss are important. Windows for passing the mode between an evacuated section such as an electron tube output and a gas-filled section have generally been a circular disc of glass or ceramic sealed across the hollow bore of the waveguide. U.S. Pat. No. 3,255,377 issued July 7, 1966 to W. C. Sylvernal and U.S. Pat. No. 3,096,462 issued Mar. 21, 1960 to J. Feinstein, both co-assigned with the present invention, disclose circular-mode windows of the prior art.

Two problems have arisen in prior-art windows. Dielectric heating can raise the temperature of a central area above that of the supported periphery until the window breaks from mechanical stress. Also, modes can exist in the dielectric-loaded region of the window which cannot propagate in the empty waveguide itself. These "ghost" or trapped modes represent high-Q standing-wave resonances which can be coupled to the transmitting mode by slight assymetries in the structure. They then can build up in wave amplitude until the dielectric window fails by thermal stress or a radio-frequency arc occurs.

In circular-electric-field waveguides, another problem is that the guide is large enough to propagate other lower-order modes. Preferential absorption of unwanted circular modes has been suggested by providing slots in the waveguide perpendicular to the axis which couple non-circular modes to an external wave absorber. Since the circular mode has no axial current component, no current crosses the slots and hence very little power is lost to the absorber.

SUMMARY OF THE INVENTION

An object of the invention is to provide a microwave window assembly for circular-electric-field waveguide capable of transmitting high power at high frequency.

A further object is to provide a window assembly free from trapped-mode resonances.

A further object is to provide a window assembly which acts as an absorptive filter for non-circular modes.

These objects are achieved by using two parallel plates of dielectric to form the wave-transmitting window. Between the plates there is a gap in the waveguide wall which serves two purposes. It carries a cooling fluid which circulates between the plates to cool them. Also, the gap extends beyond the waveguide inner surface, connecting with a region containing wave-absorbing material such as water. Non-circular modes are transmitted through the gap to the absorbing material.

DESCRIPTION OF THE PREFERRED EMBODIMENTS

Figure 1:
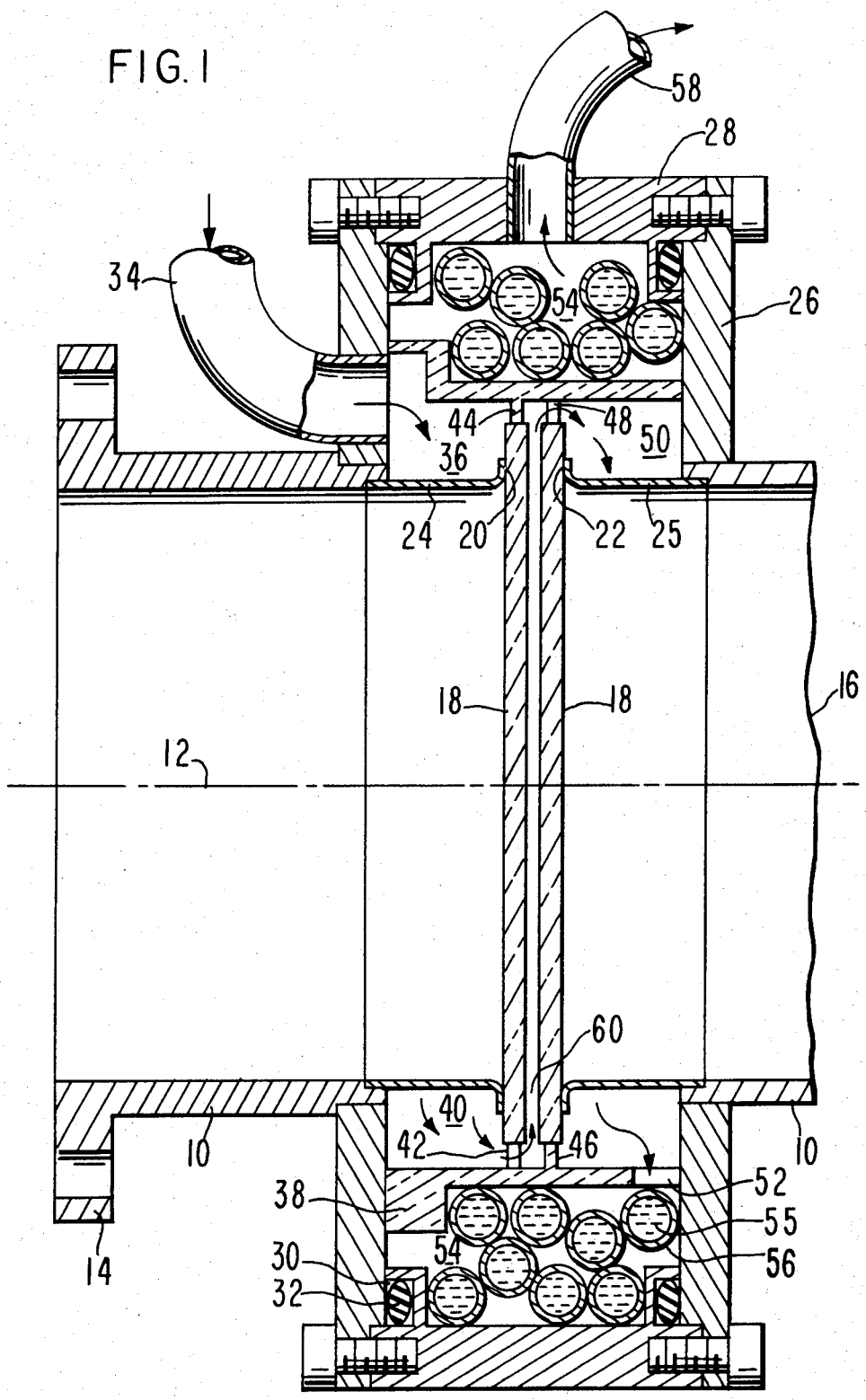
FIG. 1 is an axial cross-section of the inventive window assembly.

FIG. 1 shows an example of the inventive window assembly between two sections of circular waveguide 10 whose inner surfaces are right circular cylinders with axis 12. At one end is a waveguide flange 14 for connection to other components. The other end 16 may be the output waveguide of a microwave generating electron tube, for example. The actual vacuum-tight windows are two circular plates of dielectric 18 perpendicular to axis 12. The dielectric may be high-alumina or beryllia ceramic or single-crystal sapphire. Plates 18 are separated by a small spacing so that cooling fluid may flow between them. Near the periphery of plates 18 are metallized circular bands 20 by which they are brazed to the flanges 22 of thin metallic cylinders 24, 25, as of iron-nickel-cobalt alloy. Cylinders 24, 25 are brazed to waveguide sections 10 and form electrical continuations of them. Waveguide sections 10 are attached to mounting flanges 26 which are bolted to a common support ring 28 to hold the sections 10 firmly aligned and spaced. Support ring 28 has grooves 30 containing O-rings 32 to make the window assembly gas-tight.

A cooling fluid having low dielectric loss, such as a fluorocarbon gas or liquid is pumped in through a coolant pipe 34 at the top of the figure. It circulates through a channel 36 bounded by a dielectric cylinder 38 as of fluorocarbon polymer. It flows over the surface of thin cylinder 24, thereby cooling it. Cylinders 24, 25 are thin so that they have enough raidal flexibility to take up the thermal expansion differences from plates 18 when they are brazed together. They thus have poor thermal conductivity so that fluid cooling is advantageous. At the bottom 40 of channel 36, as shown by the flow arrows, the cooling fluid passes through a row of gaps 42 through a projecting flange 44 on the flow-confining dielectric cylinder 38. It then flows upward between window plates 18 to cool their entire area. At the top, flange 44 is impervious but the other flange 46 has a series of gaps 48 through which the fluid passes to a second circular channel 50, flowing over the second thin cylinder 25 to cool it. At the bottom of channel 50 the fluid flows through a hole 52 into an outer circular channel 54. Inside channel 54 is wave absorbing material 55, such as water contained in plastic tubes 56. The cooling fluid flows around channel 54, removing heat from tubes 56 caused by any microwave energy they absorb, to the top where it leaves the window assembly via an outlet tube 58. Heat is also removed by causing the fluid 55 to flow through the tubes 56.

In operation, very little wave energy of the circular-electric-field mode, such as $TE_{01}$, flows out of the waveguide 10 through the small gap 60 between flanges 22, because the electric currents in the wall have no axial components crossing gap 60 to induce fields in the outer wave-confining channel bounded by flanges 26 and ring 28. However, many other undesired modes do involve axial currents which couple into the outer channel where their energy is absorbed by the lossy material 55.

The circulating coolant also removes heat due to the dielectric loss in window plates 18 and due to rf current heating of thin cylinders 24, 25. Thus, the single inventive structure has removed many of the otherwise unrelated causes of window failure.

Figure 2:
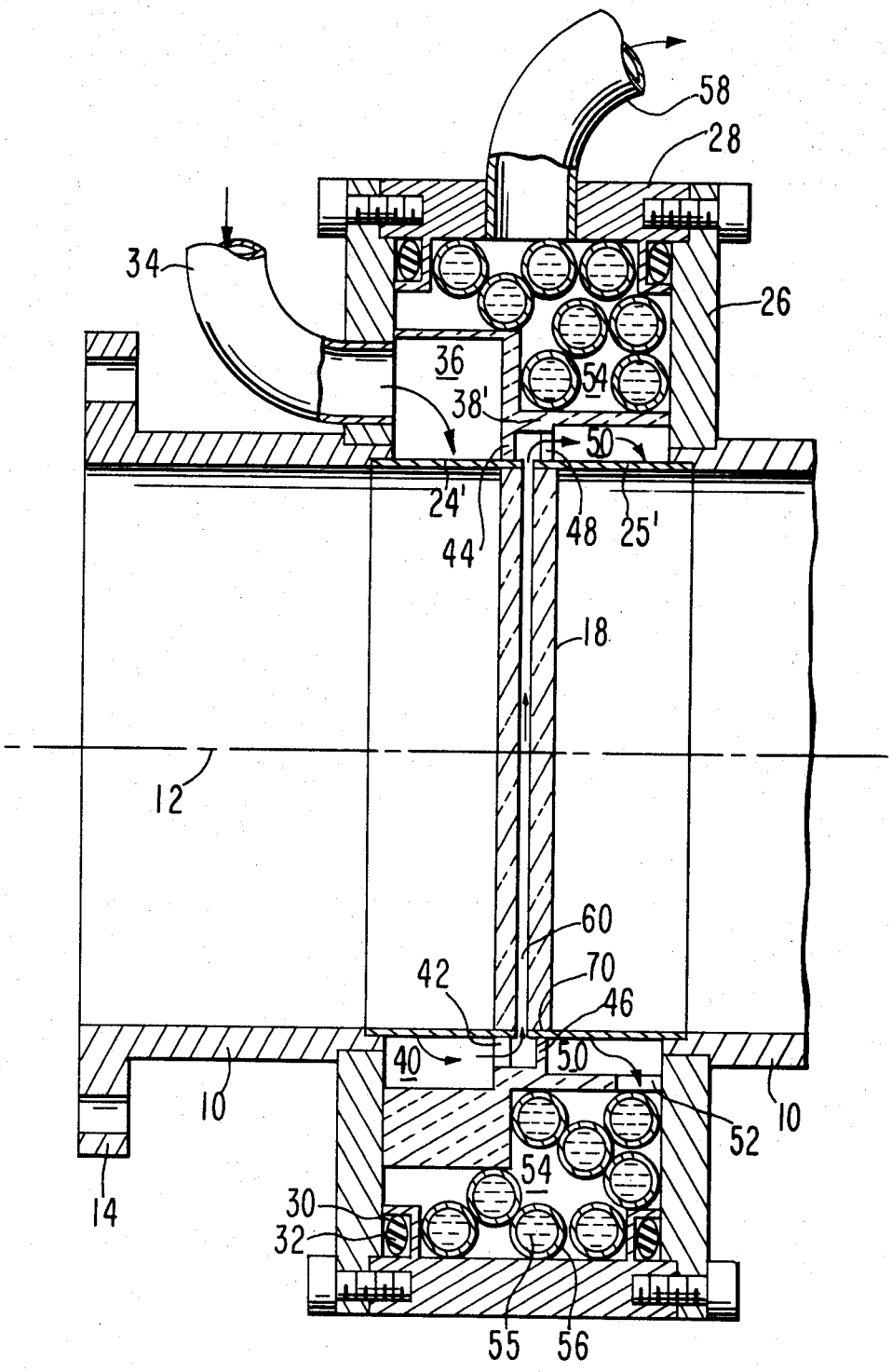
FIG. 2 is an axial section of a slightly different embodiment.

FIG. 2 is an axial section similar to FIG. 1 of a slightly different embodiment of the invention. Here the thin metallic cylinders 24', 25' which form the opposing ends of waveguide 10 are not flanged as in FIG. 1 but are brazed at their open ends 70 around the peripheries of plates 18 to form the vacuum-tight window seals. The gap 60 between plates 18 still forms a conduit for cooling fluid. Also, the axial current components of non-circular modes are interrupted by gap 60, exciting waves in outer electrical cavity 54 which are attenuated by lossy material 55. Cooling fluid enters via inlet tube 34, as shown by the flow arrow. It flows into an upper plenum chamber 36 and down around circular channel 40 in the fluid-confining partition 38', in cooling contact with thin cylinder 24' to cool it. Thence the fluid goes through a plurality of holes 42 in flange 44 of fluid-container 38' into the bottom of gap 60 between waveguide cylinders 24', 25'. The fluid then flows upward between dielectric plates 18 to cool them, out through a plurality of holes 48 in a second flange 46 of fluid confiner 38' into circular channel 50, down around channel 50 cooling thin cylinder 25'. It then flows out through an aperture 52 into the outer coolant channel 54, up around channel 54 to cool lossy material 55, and out through coolant exit pipe 58.

It will be obvious to those skilled in the art that many different mechanical configurations may be made within the scope of the invention. The pattern of flow of the liquid or gas coolant can have many variations. The lossy material may be solid or liquid, and if liquid may be cooled by circulating it. The lossy material may also be a coolant-directing barrier such as 38 (FIG. 1).

The embodiments described above are exemplary and not to be held as limiting. The true scope of the invention is to be defined only by the following claims and their legal equivalents.

We claim:

1. A window assembly for waveguide of circular and hollow cross section and having an inner conducting wall in which an axial gap is defined, comprising:

two dielectric plates extending across said section of said waveguide, sealed to said waveguide on opposing sides of said gap;

means for circulating a fluid coolant through said gap and between said plates;

means external to said waveguide for containing waveabsorbing material;

and means extending outward from said inner conducting wall for connecting said gap in wavetransmitting relation with said means for containing waveabsorbing material.

2. The window assembly of claim 1 wherein said waveabsorbing material is a dielectric liquid and said containing means includes means for circulating said liquid.

3. The window assembly of claim 1 wherein said waveabsorbing material is a solid dielectric.

4. The window assembly of claim 3 further including means for circulating said fluid coolant past said dielectric.

* * * * *

UNITED STATES PATENT AND TRADEMARK OFFICE

CERTIFICATE OF CORRECTION

PATENT NO. : 4,286,240

DATED : August 25, 1981

INVENTOR(S) : James F. Shively, Steven J. Evans, Howard R. Jory, M. Mizuhara

It is certified that error appears in the above-identified patent and that said Letters Patent are hereby corrected as shown below:

Column 1, following line 12, insert the following paragraph:

-- The Government has rights in this invention pursuant to Contract No. W-7405-ENG-26 awarded by the U. S. Department of Energy. --

Signed and Sealed this

*Nineteenth* Day of *July 1983*

[SEAL]

*Attest:*

GERALD J. MOSSINGHOFF

*Attesting Officer*

*Commissioner of Patents and Trademarks*